US008464457B2

(12) United States Patent
Troy et al.

(10) Patent No.: US 8,464,457 B2
(45) Date of Patent: Jun. 18, 2013

(54) FIREARM HANDGUARD SYSTEM

(75) Inventors: Stephen P. Troy, Lee, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 0 days.

(21) Appl. No.: 13/349,796

(22) Filed: Jan. 13, 2012

(65) Prior Publication Data

US 2012/0186123 A1 Jul. 26, 2012

Related U.S. Application Data

(60) Provisional application No. 61/432,742, filed on Jan. 14, 2011.

(51) Int. Cl.
*F41C 23/00* (2006.01)

(52) U.S. Cl.
USPC ..... 42/71.01; 42/90; 42/85

(58) Field of Classification Search
USPC ..... 42/71.01, 72, 75.03, 85, 90
See application file for complete search history.

(56) References Cited

U.S. PATENT DOCUMENTS

| | | | | |
|---|---|---|---|---|
| 5,826,363 | A * | 10/1998 | Olson | 42/75.01 |
| 6,606,812 | B1 * | 8/2003 | Gwinn, Jr. | 42/75.02 |
| 6,671,990 | B1 * | 1/2004 | Booth | 42/75.01 |
| 7,216,451 | B1 * | 5/2007 | Troy | 42/72 |
| 8,037,633 | B1 * | 10/2011 | Troy | 42/71.01 |
| 8,046,949 | B1 * | 11/2011 | Daniel | 42/75.02 |
| 8,316,574 | B1 * | 11/2012 | Swan | 42/146 |
| 2003/0074822 | A1 * | 4/2003 | Faifer | 42/71.01 |
| 2007/0033851 | A1 * | 2/2007 | Hochstrate et al. | 42/75.01 |
| 2007/0261285 | A1 * | 11/2007 | Troy | 42/75.03 |
| 2009/0013579 | A1 * | 1/2009 | Fluhr | 42/71.01 |
| 2011/0126443 | A1 * | 6/2011 | Sirois | 42/90 |
| 2012/0042557 | A1 * | 2/2012 | Gomez et al. | 42/90 |
| 2012/0180358 | A1 * | 7/2012 | Samson et al. | 42/71.01 |
| 2012/0246989 | A1 * | 10/2012 | Troy | 42/71.01 |

* cited by examiner

*Primary Examiner* — Michael Carone
*Assistant Examiner* — Derrick Morgan
(74) *Attorney, Agent, or Firm* — Parsons & Goltry; Robert A. Parsons; Michael W. Goltry

(57) ABSTRACT

A clamping mechanism for attaching a handguard to a firearm includes a barrel nut having radially outwardly directed tines, a tubular body having a plurality of longitudinal grooves separated by lands forming an inner surface of the tubular body, and a pair of circumferentially extending grooves traversing the lands, formed forward from a rearward end of the tubular body. A clamp element is carried by the tubular body and includes a body with a beveled end and a heel extending substantially perpendicularly from an opposing end of the body. The clamp element is adjustably positioned within the tubular body with the heel extending radially outwardly and received in the second groove and the beveled end engages the barrel nut.

11 Claims, 5 Drawing Sheets

FIREARM HANDGUARD SYSTEM

CROSS-REFERENCE TO RELATED APPLICATIONS

This application claims the benefit of U.S. Provisional Application No. 61/432,742 filed 14 Jan. 2011.

FIELD OF THE INVENTION

This invention relates to firearms.

More particularly, the present invention relates to handguards for use on firearms.

BACKGROUND OF THE INVENTION

In the field of firearms, handguards are ubiquitous and ever changing. Originally, handguards were used to provide something to grasp while firing the weapon. The handguard provided a comfortable grip and protected the user's hands from the heat of the barrel. Over the years, methods of attachment of handguards and additions to the handguard have been developed to prevent adverse effect to accuracy and provide attachment points for accessories. Free floating handguards have been found to provide firearms with the best accuracy by eliminating flexing or warping of the barrel. The problems faced by a free floating handguard are maintaining sufficient rigidity and strength. Attachment points for accessories are a separate consideration with the problem of alignment added to rigidity and strength.

It would be highly advantageous, therefore, to remedy the foregoing and other deficiencies inherent in the prior art.

An object of the present invention is to provide a new and improved handguard for a firearm.

Another object of the present invention is to provide a rigid and strong free floating handguard.

Yet another object of the present invention is to provide a free floating handguard having accessory attachment points which can be aligned with the firearm.

SUMMARY OF THE INVENTION

Briefly, to achieve the desired objects and advantages of the instant invention, provided is a handguard system for use on a firearm having a receiver, a barrel and a barrel nut affixing the barrel to the receiver. The barrel nut has radially outwardly directed tines spaced about the outer periphery thereof. The handguard system includes a tubular body having a rearward end, a forward end and an inner surface. The tubular body is receivable over the barrel of a firearm with the rearward end receivable over the barrel nut. A plurality of longitudinal grooves separated by lands forms the inner surface of the tubular body and extends longitudinally from the rearward end toward the forward end. The plurality of longitudinal grooves is spaced apart around the periphery of the inner surface so as to correspond with the tines on the barrel nut. The lands are traversed by a first circumferentially extending groove formed forward from the rearward end of the tubular body so as to receive the tines of the barrel nut therein, and a second circumferentially extending groove spaced forwardly to and parallel with the first circumferentially extending groove. A clamp element includes a body with a beveled end and a heel extending substantially perpendicularly from an opposing end of the body. The clamp element is adjustably positioned within the tubular body with the heel extending radially outwardly and received in the second groove.

In a further aspect, the tubular body is rotatable between an installation position with the plurality of longitudinal grooves aligned with the tines of the barrel nut, in which position the tubular body is slidably movable over the barrel nut until the tines reach the first circumferential groove, and a secure position wherein the tines move within the first circumferential groove until they are positioned behind the lands.

In yet a further aspect, the handguard system includes a stop mechanism limiting the rotation of the tubular body to a position in which the tines of the barrel nut are misaligned with the grooves and are aligned with the lands.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
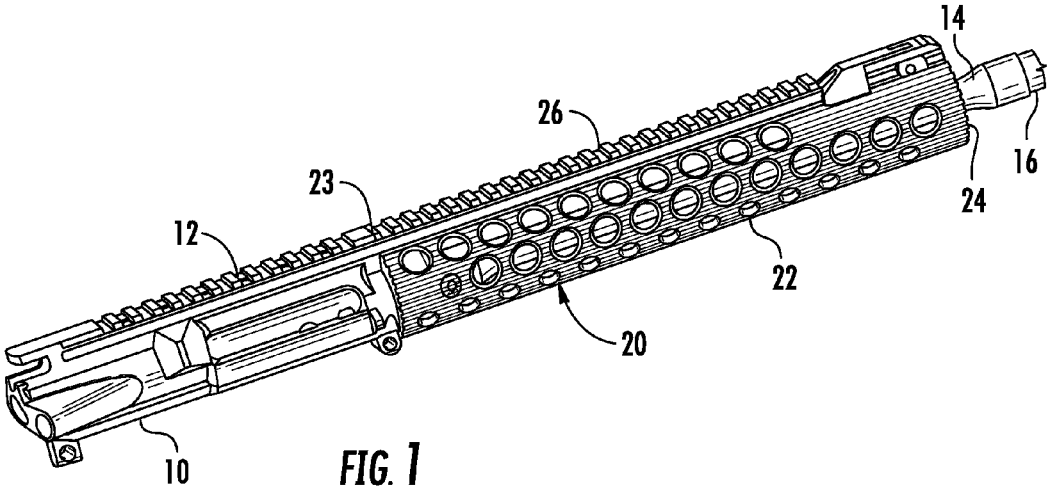
FIG. 1 is a top perspective view of a handguard system according to the present invention.
Figure 2:
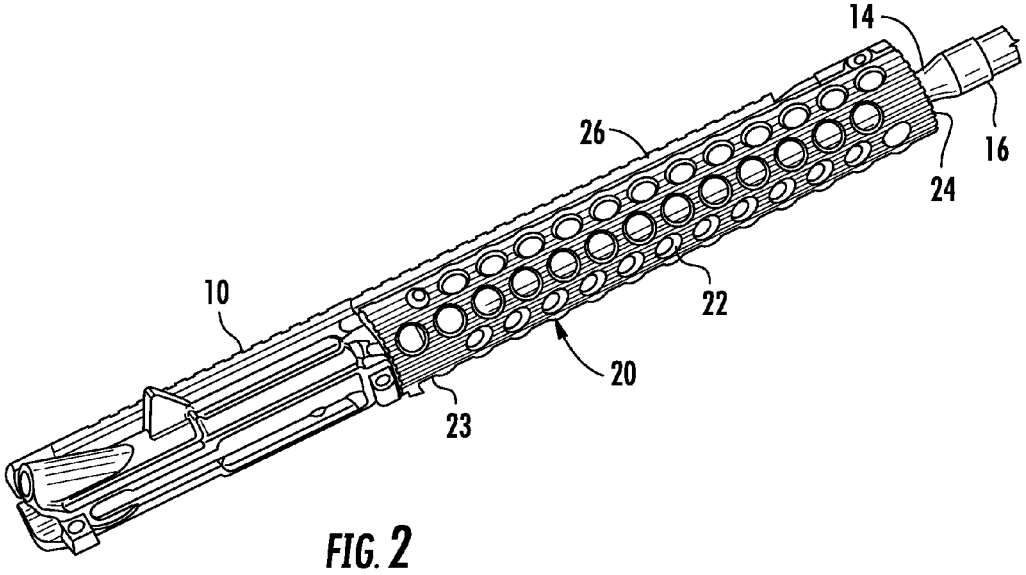
FIG. 2 is a bottom perspective view of the handguard system of FIG. 1.

Turning now to the drawings in which like reference characters indicate corresponding elements throughout the several views, attention is directed to FIGS. 1 and 2 which illustrate a receiver 10 having a rail 12 formed on an upper surface thereof, a barrel 14 extending from receiver 10 and terminating in a muzzle 16, and a handguard system generally designated 20 coupled thereto. Handguard system 20 includes a tubular body 22 having a rearward end 23 and a forward end 24. It will of course be understood that the cross-section could be oval, square, rectangular, or any cylindrical configuration but primarily is hollow or tubular so as to surround at least a portion of the barrel of a firearm without coming in contact therewith along the length of the barrel that is surrounded. For reasons that will become apparent presently, a handguard with a round cross-section is preferred because it is the simplest to form and manufacture. A rail 26 can be formed along a top surface of tubular body 22, and configured to align with rail 12 of receiver 10 when properly positioned. It should be noted that tubular body 22 is formed in a single piece with an absence of splits at the ends, providing a strong tubular structure that can be manufactured from some convenient material, such as a metal (aluminum, light steel, etc.), for example, by extruding or the like. The length of tubular body 22 is such that when mounted on a firearm, it extends from a front surface of receiver 10 to a distance short of muzzle 16 of barrel 14 for easy and convenient gripping by a user and protection of the user's hand from the barrel. Additionally, it will be understood that the term "rearward" is intended to indicate a direction toward receiver 10 and the term "forward" is intended to indicate a direction toward muzzle 16.

Figure 3:
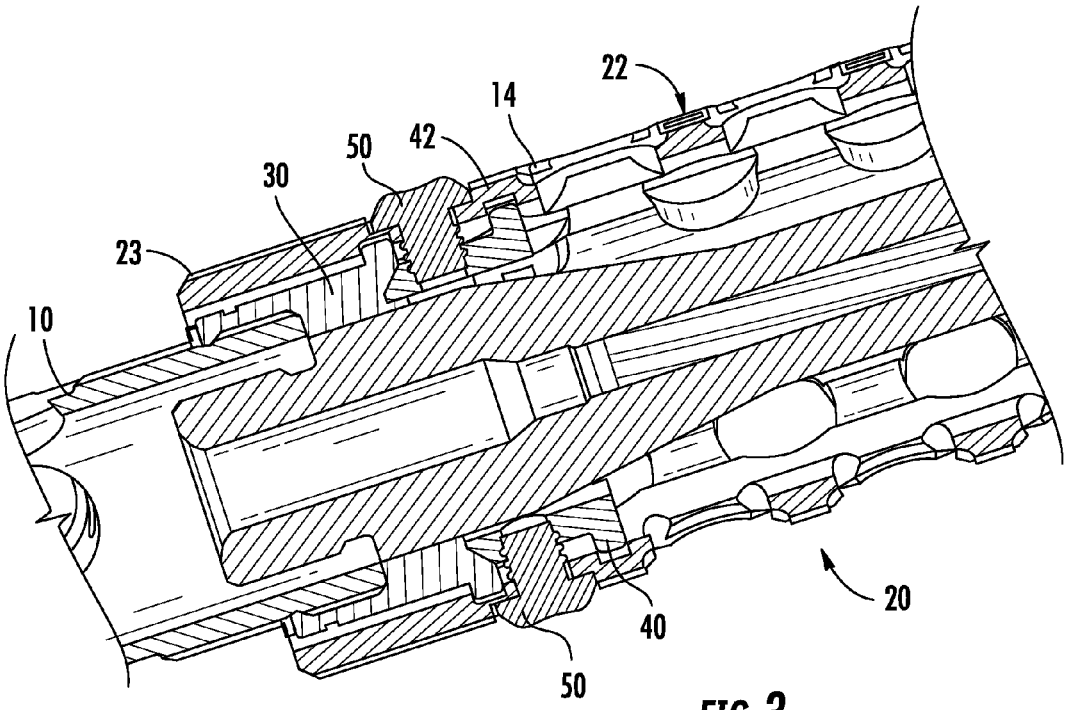
FIG. 3 is an enlarged cross section of the attachment assembly of the handguard system.
Figure 10:
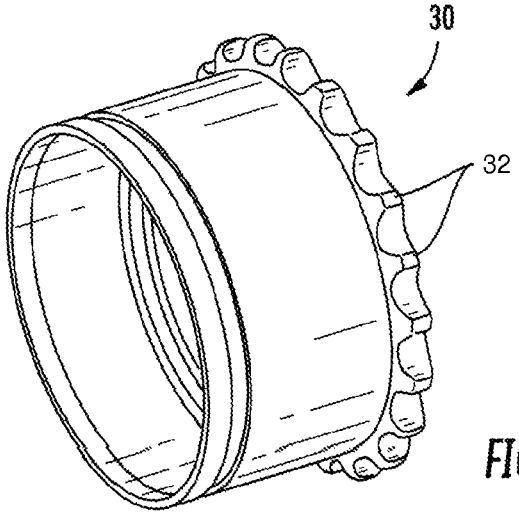
FIG. 10 is a perspective view of a barrel nut.

Referring now to FIG. 3, a cross sectional view of handguard system 20 at rearward end 23 of tubular body 22 is illustrated. Barrel 14 is attached to receiver 10 by a barrel nut 30. With momentary reference to FIG. 10, barrel nut 30 is a standard barrel nut having an outer diameter (periphery), designated 'd', and includes a plurality of regularly spaced tines 32, extending radially outwardly from the outer periphery at the forward end thereof. Tines 32 are provided to allow the application of a tool (spanner wrench) for inserting/tightening and removing/loosening barrel nut 30 into and out of the firearm. To provide space for the proper application of the tool, barrel nut 30 is constructed to be positioned so that when in the installed or tightened position, tines 32 are spaced slightly from the front surface of receiver 10. Barrel nut 30 couples barrel 14 to receiver 10 in a manner well known to those skilled in the art, and therefore will not be described in detail herein.

Figure 4:
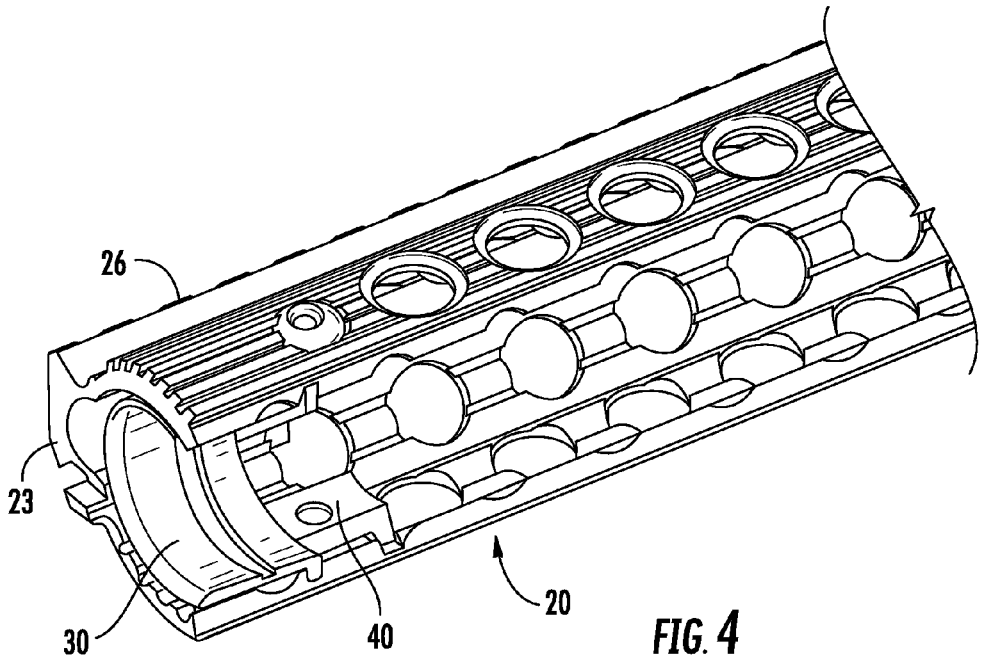
FIG. 4 is a sectional perspective view of the attachment assembly of the handguard system.
Figure 9:
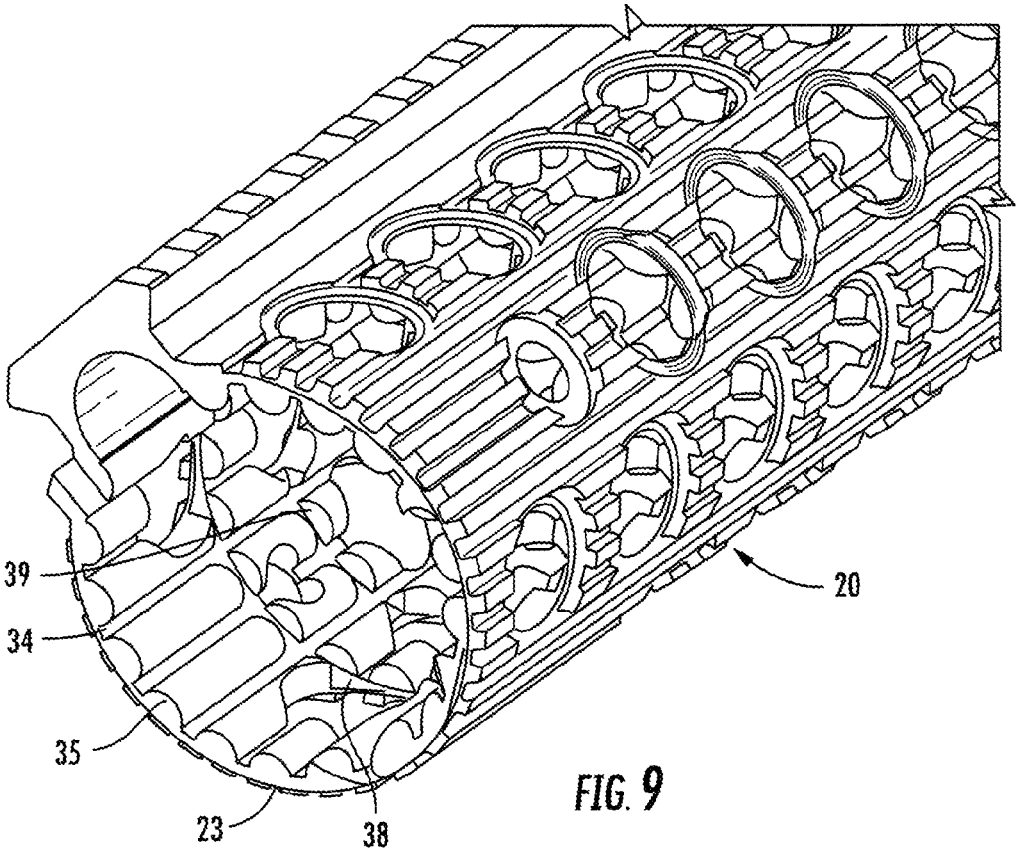
FIG. 9 is an enlarged end view of the handguard.

Still referring to FIG. 3, rearward end 23 of tubular body 22 is positioned over and is coupled to barrel nut 30. With momentary reference to FIG. 9, an inner surface of tubular body 22 includes a plurality of grooves 34 separated by lands 35 formed around the inner circumference of tubular body 22 and extending longitudinally from rearward end 23 toward forward end 24. Grooves 34 are evenly distributed around the inner periphery of tubular body 22 with a land 35 formed between each pair of grooves 34. Depending upon the process used to form tubular body 22, grooves 34 may extend partially along the length or completely along the length of thereof. For example, if an extrusion process is used grooves 34 are formed to extend the entire length of tubular body 22 and would further reduce the overall weight. Lands 35 are traversed by a pair of spaced apart circumferential grooves 38 and 39, formed forward from rearward end 23. With additional reference to FIG. 4, it can be seen that tubular body 22 is oriented in an installation position with grooves 34 aligned with tines 32 of barrel nut 30. In this orientation, tubular body 22 is slidably moved over barrel nut 30 until tines 32 reach groove 38. Tubular body 22 is then rotated to a secure position. Rotation of tubular body 22 to the secure position moves tines 32 within groove 38 until they are positioned behind lands 35. This is preferably a rotation of approximately eight degrees, and also aligns rail 26 with rail 12 of receiver 10. Stops can be provided to prevent over rotation of tubular body 22 past the desirable position. In the preferred embodiment, the width of groove 38 is slightly larger than the longitudinal width of tines 32 and the depth is approximately equal to the length of tines 32. Also, the distance groove 38 is positioned from rearward end 23 is approximately the distance between tines 32 and the front surface of receiver 10 when barrel nut 30 is fully tightened into an operating position.

Figure 5:
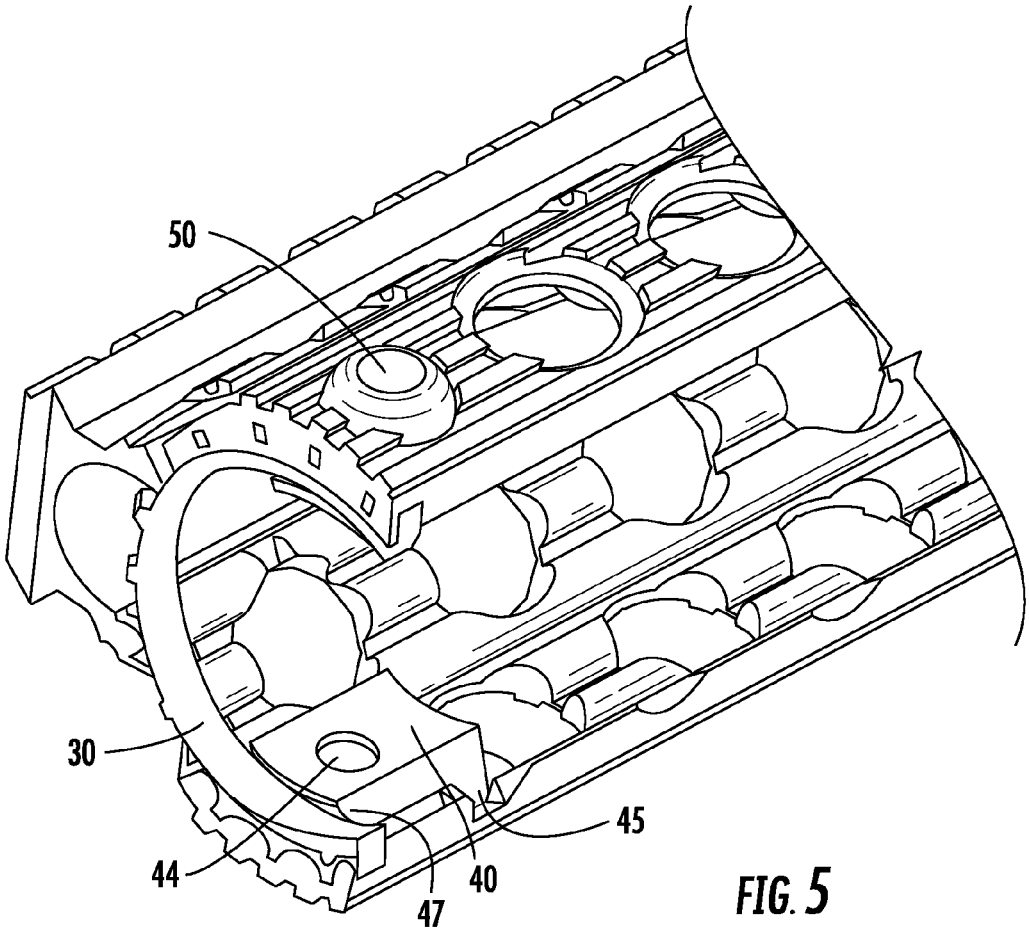
FIG. 5 is an enlarged view of FIG. 4 with portion thereof cut-away.
Figure 6:
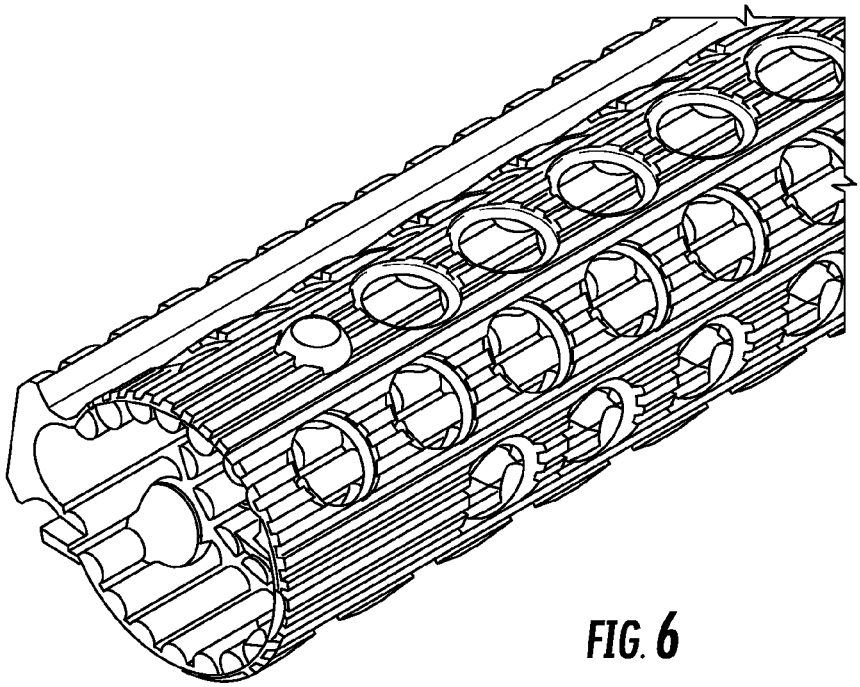
FIG. 6 is an enlarged end view of the handguard showing installed clamp elements.
Figure 7:
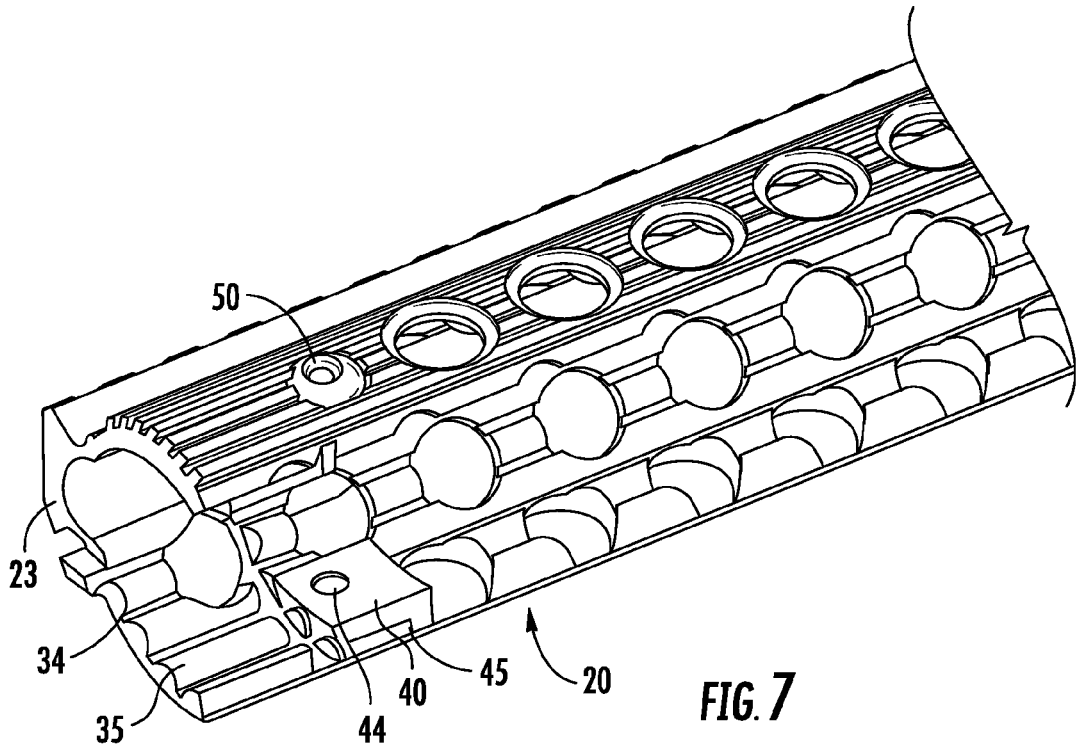
FIG. 7 is the view of FIG. 6 with portions removed.
Figure 8:
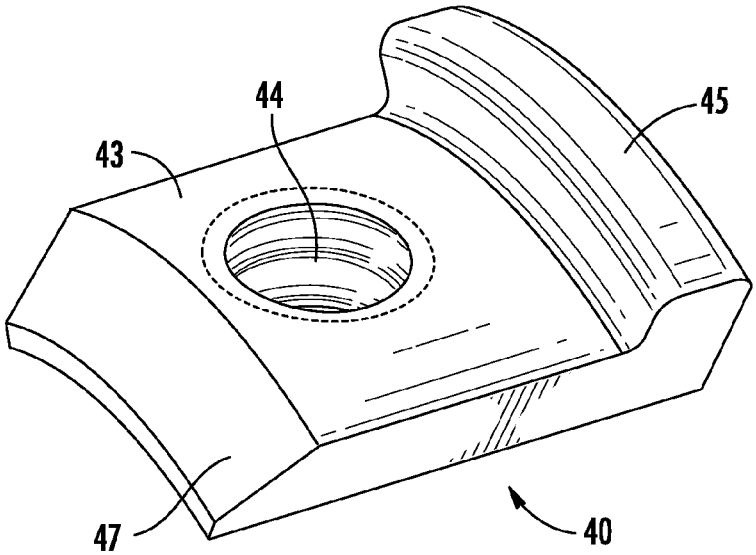
FIG. 8 is a perspective view of a clamp element.

Referring back to FIG. 3, with additional reference to FIGS. 5, 6 and 7, tubular body 22 is restrained in the secure position by a clamp assembly including clamp elements 40 and 42. More clamp elements can be employed as desired and are preferably evenly distributed around the barrel nut. With momentary reference to FIG. 8, clamp elements 40 and 42 each include a body 43 having a threaded aperture 44 therethrough, a heel 45 extending substantially perpendicularly from an end of body 43, and a beveled end 47. Clamp elements are positioned within tubular body 22 with heels 45 extending radially outwardly and received in groove 39. A fastener, such as a screw 50, is inserted through tubular body 22 and received in threaded aperture 44. Clamp elements 40 and 42 are positioned prior to positioning tubular body 22 over barrel nut 30. With tubular body 22 properly oriented in the secure positioned, beveled ends 47 of clamp elements 40 and 42 engage barrel nut 30 on an inner edge of the forward end. As screws 50 are tightened, beveled ends 47 push against barrel nut 30 and with heels 45 secure within groove 39, tubular body 22 is forced forwardly toward muzzle 16. The tension pulls lands 35 tightly against the rearward side of tines 32, securing and aligning tubular body 22. Alignment is improved by positioning clamp elements 40 and 42 equidistance around the periphery of the barrel nut to provide offsetting tensions. This can be accomplished using multiple clamp elements.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A handguard system for use on a firearm having a receiver, a barrel and a barrel nut affixing the barrel to the receiver, the barrel nut having radially outwardly directed tines spaced about an outer periphery thereof, the handguard system comprising:

a tubular body having a rearward end, a forward end and an inner surface, the tubular body receivable over the barrel of a firearm with the rearward end receivable over the barrel nut;

a plurality of longitudinal grooves separated by lands forming the inner surface of the tubular body and extending longitudinally from the rearward end toward the forward end, the plurality of longitudinal grooves being spaced apart around the periphery of the inner surface so as to correspond with the tines on the barrel nut;

the lands are traversed by a first circumferentially extending groove formed forward from the rearward end of the tubular body so as to receive the tines of the barrel nut therein, and a second circumferentially extending groove spaced forwardly to and parallel with the first circumferentially extending groove; and a clamp element having a body with a beveled end and a heel extending substantially perpendicularly from an opposing end of the body, adjustably positioned within the tubular body with the heel extending radially outwardly and received in the second groove.

2. A handguard system as claimed in claim 1 wherein the clamp element further includes a threaded aperture formed through the body and a fastener inserted through the tubular body and received in the threaded aperture.

3. A handguard system as claimed in claim 1 further including a second clamp element having a body with a beveled end and a heel extending substantially perpendicularly from an opposing end of the body, adjustably positioned within the tubular body with the heel extending radially outwardly and received in the second groove.

4. A handguard system as claimed in claim 1 further including a mounting rail on an upper surface of the tubular body axially alignable with a mounting rail on the upper surface of the firearm receiver.

5. A firearm comprising:

a receiver;

a barrel extending from the receiver and terminating in a muzzle;

a barrel nut affixing the barrel to the receiver, the barrel nut having radially outwardly directed tines spaced about an outer periphery thereof;

a tubular body having a rearward end, a forward end and an inner surface, the tubular body received over the barrel with the rearward end received over the barrel nut;

a plurality of longitudinal grooves separated by lands forming the inner surface of the tubular body and extending longitudinally from the rearward end toward the forward end, the plurality of longitudinal grooves being spaced apart around the periphery of the inner surface so as to correspond with the tines on the barrel nut;

the lands are traversed by a first circumferentially extending groove formed forward from the rearward end of the tubular body, and a second circumferentially extending groove spaced forwardly to and parallel with the first circumferentially extending groove;

wherein the tubular body is rotatable between an installation position with the plurality of longitudinal grooves aligned with the tines of the barrel nut, in which position the tubular body is slidably movable over the barrel nut until the tines reach the first circumferential groove, and a secure position wherein the tines move within the first circumferential groove until they are positioned behind the lands; and a clamp element having a body with a beveled end and a heel extending substantially perpendicularly from an opposing end of the body, adjustably positioned within the tubular body with the heel extending radially outwardly and received in the second groove and the beveled end engaging the barrel nut.

6. A firearm as claimed in claim 5 wherein the clamp element further includes a threaded aperture formed through the body and a fastener inserted through the tubular body and received in the threaded aperture, the fastener movable to a tightened position forcing the tubular body forwardly against the tines of the barrel nut at the first circumferential groove.

7. A firearm as claimed in claim 5 further including a second clamp element having a body with a beveled end and a heel extending substantially perpendicularly from an opposing end of the body, adjustably positioned within the tubular body with the heel extending radially outwardly and received in the second groove.

8. A firearm as claimed in claim 5 further including a mounting rail on an upper surface of the tubular body axially aligned with a mounting rail on the upper surface of the firearm receiver with the tubular body in the secured position.

9. A clamping mechanism for attaching a handguard to a firearm comprising:

a barrel nut having radially outwardly directed tines spaced about an outer periphery thereof;

a tubular body having a rearward end, a forward end and an inner surface, the rearward end of the tubular body received over the barrel nut;

a plurality of longitudinal grooves separated by lands forming the inner surface of the tubular body and extending longitudinally from the rearward end toward the forward end, the plurality of longitudinal grooves being spaced apart around the periphery of the inner surface so as to correspond with the tines on the barrel nut;

the lands are traversed by a first circumferentially extending groove formed forward from the rearward end of the tubular body, and a second circumferentially extending groove spaced forwardly to and parallel with the first circumferentially extending groove;

wherein the tubular body is rotatable between an installation position with the plurality of longitudinal grooves aligned with the tines of the barrel nut, in which position the tubular body is slidably movable over the barrel nut until the tines reach the first circumferential groove, and a secure position wherein the tines move within the first circumferential groove until they are positioned behind the lands; and a clamp element having a body with a beveled end and a heel extending substantially perpendicularly from an opposing end of the body, adjustably positioned within the tubular body with the heel extending radially outwardly and received in the second groove and the beveled end engaging the barrel nut.

10. A clamping mechanism as claimed in claim 9 wherein the clamp element further includes a threaded aperture formed through the body and a fastener inserted through the tubular body and received in the threaded aperture, the fastener movable to a tightened position forcing the tubular body forwardly against the tines of the barrel nut at the first circumferential groove.

11. A clamping mechanism as claimed in claim 9 further including a second clamp element having a body with a beveled end and a heel extending substantially perpendicularly from an opposing end of the body, adjustably positioned within the tubular body with the heel extending radially outwardly and received in the second groove.

* * * * *